United States Patent [19]

Bratt et al.

[11] 4,069,670

[45] Jan. 24, 1978

[54] HOT GAS ENGINE HEATER HEAD

[75] Inventors: Jan Christer Bratt, Malmo; Stefan Istvan Lorant, Oxie; Bengt-Ove Moody Moodysson, Akarp; Nils Kaj Gunnar Rosenqvist, Malmo, all of Sweden

[73] Assignee: Kommanditbolaget United Stirling (Sweden) AB & Co., Malmo, Sweden

[21] Appl. No.: 710,745

[22] Filed: Aug. 2, 1976

[30] Foreign Application Priority Data

Mar. 9, 1976 United Kingdom ..... 9281/76

[51] Int. Cl.[2] ..... F02G 1/04

[52] U.S. Cl. ..... 60/517; 165/176

[58] Field of Search ..... 60/517, 524, 525; 165/176, 51

[56] References Cited

U.S. PATENT DOCUMENTS

| | | | |
|---|---|---|---|
| 2,817,950 | 12/1957 | Van Weenen et al. | 60/525 |
| 3,015,475 | 1/1962 | Meijer et al. | 60/517 |
| 3,808,815 | 5/1974 | Friedemann | 165/176 |
| 3,965,976 | 6/1976 | Barton | 60/517 |

FOREIGN PATENT DOCUMENTS

| | | | |
|---|---|---|---|
| 8,151 of | 1900 | United Kingdom | 165/176 |

*Primary Examiner*—Charles J. Myhre
*Assistant Examiner*—Sheldon Richter
*Attorney, Agent, or Firm*—Lawrence R. Brown

[57] ABSTRACT

In a heater head for a hot gas engine the connection between the regenerator tops and the cylinder tops consists of pipes of equal shape and dimensions. The pipes are shaped partly as involutes on a cone partly as straight tubes on a cylinder surface to ensure uniform gaps between them.

9 Claims, 5 Drawing Figures

HOT GAS ENGINE HEATER HEAD

BACKGROUND

Heater heads for hot gas engines must offer a predetermined resistance against inner flow of working gas and they must be arranged in such a way relative each other that they offer a predetermined resistance against a flow of combustion gas between them, the arrangement being such that the temperature of the heater head may be constant and uniform all along the heater head and at all loads of the hot gas engine.

Hitherto this has been obtained by using a great number of pipes of different length and shape or it has been necessary to use manifolds extending into central parts of the heater head requiring extra shields or pipe bends as protection against overheating.

Example of prior art literature: U.S. Pat. No. 2,817,950.

This invention relates to a hot gas engine heater head of the kind (herein called "the kind defined") comprising heater pipes in an annular disposition around a central axis for heating by common combustion means, the heater pipes connecting cylinder tops to respective regenerator housings.

A heater head of the kind defined should fulfil several requirements. One of these requirements is simplicity in manufacture; another is proper resistance against the working gas flow within the heater pipes as well as against the flow of combustion gases between the heater pipes.

According to the present invention a hot gas engine heater head of the kind defined is characterised in that each heater pipe has a curved portion of a shape which corresponds substantially to the shape of an involute curve upon a conical surface, the curved portions of the heater pipes being disposed uniformly and equi-spaced side-by-side.

In an advantageous construction each heater pipe has a substantially straight portion which extends substantially parallel to the said central axis.

For convenience the straight portions of the heater pipes extend along a right-cylindrical surface of which the axis coincides with the central axis.

For economy in manufacture the heater pipes may be all similar to one another.

In a preferred arrangement the curved portions of the heater pipes are connected through manifolds to the respective regenerator housings, and the manifolds to the regenerator housings substantially constitute a ring centred upon the central axis, and the substantially straight portion of the heater pipes are connected through manifolds to the respective cylinder tops, and the manifolds to the cylinder tops substantially constitute a ring centred upon the said central axis.

Figure 1:
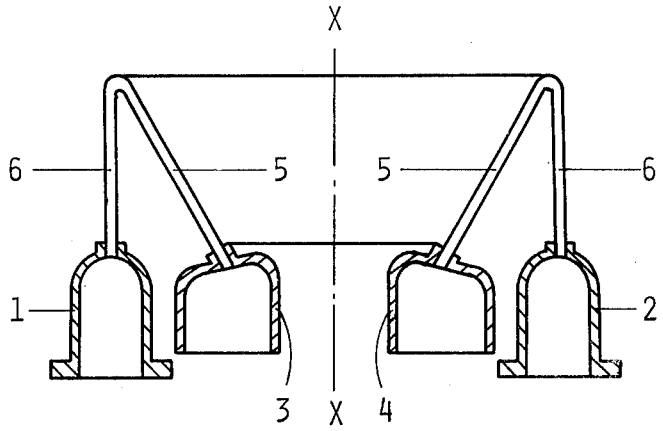
Figure 2:
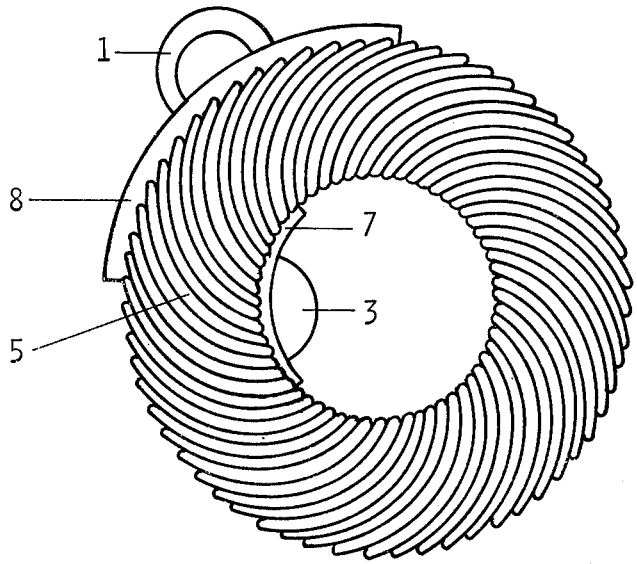
Figure 3:
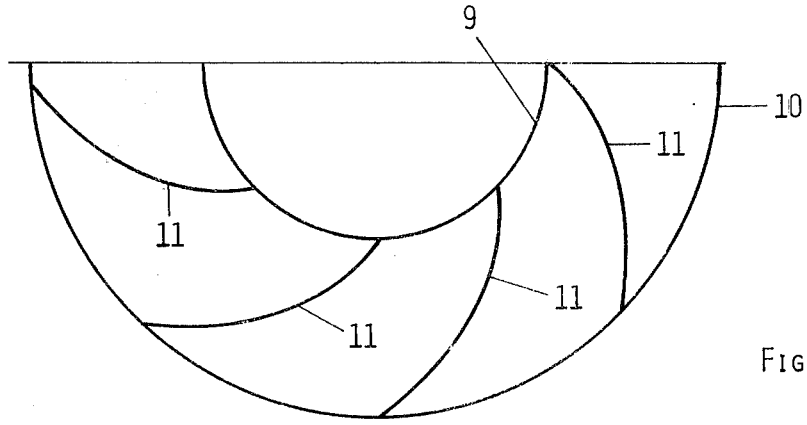
Figure 4:
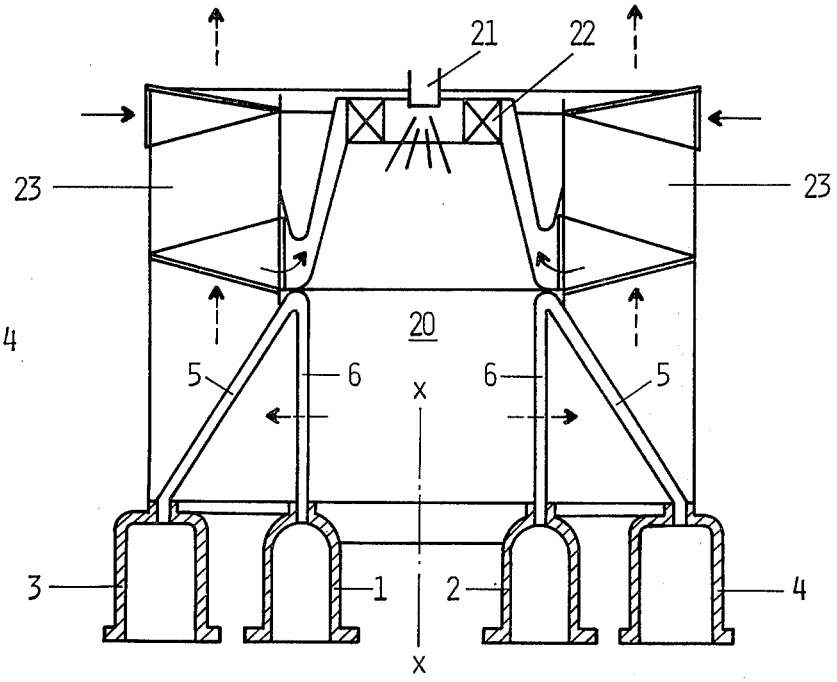
Figure 5:
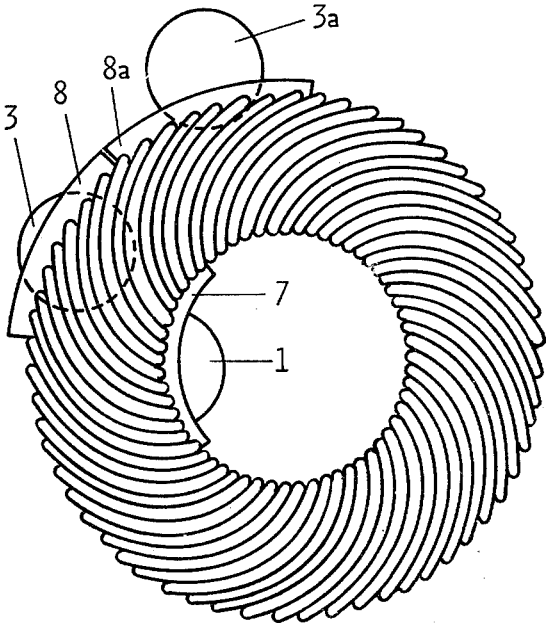

How the invention may be put into practice is described in more detail by way of example with reference to the accompanying drawing, in which FIG. 1 schematically shows a vertical section through some parts of a heater head according to the invention, FIG. 2 shows some parts of a heater head according to the invention as viewed from above - but for reasons of clarity only showing one regenerator and one cylinder top, FIG. 3 shows the geometric path of some pipe parts in a plane development, FIG. 4 schematically shows a vertical section through a combustion chamber and some parts of another heater head according to the invention, and FIG. 5 shows some parts of the heater head of FIG. 4 as viewed from above — but for reasons of clarity showing only two regenerator tops and one cylinder top.

Referring first to FIG. 1 and FIG. 2, the heater head comprises cylinder tops 1 and 2 connected to respective regenerator housings 3 and 4 by means of similar heater pipes and manifolds 8 and 7. The pipes comprise parts 5 extending along a cone and parts 6 extending along a cylinder. As shown in FIG. 2 a regenerator housing 3 is provided with a manifold 7 and the corresponding cylinder top 1 is provided with a manifold 8. The pipe parts 5 extend from the manifold 7 spirally upwards and outwards, and the parts 6 extend straight downwards.

The pipe parts 5 are located on an imaginary conical surface, and FIG. 3 shows how the conical surface may be developed in a plane, the surface extending between an inner half-circle 9 and an outer half-circle 10. The pipe parts 5 follow involute curves 11 between the half-circles 9 and 10 in the plane development.

In a three-dimensional development the area between the half-circles 9 and 10 would form a frustum of a cone having an included angle of 60 degrees.

Advantages of the illustrated construction are that all the heater pipes are of equal length, shape and resistance against internal gas flow. Another advantage is that the pipe parts 5 are located beside each other, leaving gaps between them of equal resistance against outer flow of combustion gases in directions transverse to the pipe parts 5.

An advantage of mounting the regenerators nearer to and the cylinders at a greater radial distance from the central axis of the heater head is that the manifolds 7 may be of small dimensions. Tests and calculations show that such a design gives good efficiency.

It can be seen that each heater pipe has a curved portion 5 of a shape which corresponds substantially to the shape of an involute curve upon a conical surface, the curved portions 5 of the heater pipes being disposed uniformly and equi-spaced side-by-side.

Further, each heater pipe has a substantially straight portion 6 which extends substantially parallel to the said central axis X—X, and the straight portions 6 of the heater pipes extend along a right-cylindrical surface of which the axis coincides with the central axis X—X.

The manifolds 7 to the regenerator housings 3 and 4 substantially constitute a ring centred upon the central axis X—X, and the manifolds 8 to the cylinder tops 1 and 2 substantially constitute a ring centred upon the said central axis X—X and of greater diameter than the ring of the manifolds 7 to the regenerator housings 3 and 4.

The embodiment of the invention shown in FIGS. 4 and 5 consists of a number of elements corresponding to those described above and shown in FIGS. 1 and 2. These elements have being provided with corresponding reference numerals in FIGS. 4 and 5.

The embodiment of FIGS. 4 and 5 differs from the one of FIGS. 1 and 2 mainly therein that the heater tube portions 5 of involute curved shape extend outwardly from the respective straight portions 6 of the heater tubes. Also the regenerator housings 3 and 4 have been located concentrically outside the cylinders 1 and 2 and the number of regenerator housings has been doubled, the regenerator housing 3 of FIG. 2 corresponding to the regenerator housings 3 and 3*a* in FIG. 5. By increasing the number of regenerator housings the advantage of using short manifolds 8 and 8*a* can be maintained.

The advantage of the embodiment of FIGS. 4 and 5 is that the gaps between the heater tubes may be constant all along the tubes — i.e. the gap between the curved parts of the tubes may be equal to the gaps between the straight portions of the tubes. As a result the heater head may be rather small for a given heat absorbing capacity.

The heater head of FIGS. 4 and 5 is mounted in a combustion chamber 20 to which fuel is supplied through a nozzle 21 and to which combustion air is supplied through a turbulence-creating device 22. The air for the combustion is pre-heated in a heat exchanger 23 by being passed in counter-flow with the combustion gases leaving the combustion chamber 20. The flow of air for the combustion is indicated by single line arrows, and the flow of combustion gases is indicated by dotted line arrows.

What we claim is:

1. A multiple cylinder hot gas engine heater head wherein a single heater passes hot gases over a plurality of heater pipes generally connecting respective cylinders with corresponding regenerator housings, characterized in that, the heater pipes have a curved portion of a shape which corresponds substantially to the shape of an involute curve upon a conical surface with the curved portions of a plurality of the heater pipes being disposed uniformly side-by-side and equi-spaced.

2. A heater head as defined in claim 1 wherein all the heater pipes are similar.

3. A heater head as defined in claim 1 including a manifold connecting the curved portions of a plurality of the heater pipes to said regenerator housings.

4. A heater head as defined in claim 3 wherein said manifold comprises substantially a ring portion disposed coaxially with said central axis.

5. A heater head as defined in claim 1 wherein the heater passes said gases generally along a central axis, and each heater pipe has connected to said cuved portion a substantially straight portion constituted by a member disposed substantially only parallel to said central axis.

6. A heater head as defined in claim 5 including a manifold connecting a plurality of said substantially straight portions to a respective cylinder.

7. A heater head as defined in claim 6 wherein said manifold comprises a ring portion disposed coaxially with said central axis.

8. A heater head as defined in claim 5 wherein the straight portions of all pipes extend along a single right-cylindrical surface coaxial with said central axis.

9. A heater head as defined in claim 8 wherein said curved portions extend outwardly from said axis from the respective straight portions.

* * * * *